US006179019B1

(12) United States Patent
Gowans et al.

(10) Patent No.: US 6,179,019 B1
(45) Date of Patent: Jan. 30, 2001

(54) SYSTEM FOR, AND METHOD OF, REMOVING A COMPONENT FROM IMMERSION IN A LIQUID

(76) Inventors: Bruce S. Gowans; Christopher B. Rider, both of Kodak Limited, Headstone Drive, Harrow, Middx. HA1 4TY (GB)

( * ) Notice: Under 35 U.S.C. 154(b), the term of this patent shall be extended for 0 days.

(21) Appl. No.: 09/347,098

(22) Filed: Jul. 2, 1999

(30) Foreign Application Priority Data

Jul. 13, 1998 (GB) ..... 9815171

(51) Int. Cl.[7] ..... B65B 1/04; B65B 3/04; B67C 3/02

(52) U.S. Cl. ..... 141/110; 141/1; 141/86; 141/112

(58) Field of Search ..... 141/110–112, 10, 141/86, 114, 311 R, 313–315, 1, 2; 222/108; 184/106

(56) References Cited

U.S. PATENT DOCUMENTS 2,555,868 * 6/1951 Bowman ..... 141/86
4,834,849 5/1989 Woog .
5,203,979 4/1993 Uffinger et al. .
5,370,781 12/1994 Van de Wynckel et al. .
5,623,755 * 4/1997 Childress et al. ..... 141/114
5,782,276 * 7/1998 Kilgore ..... 141/332
5,967,203 * 10/1999 Culver, III ..... 141/106

* cited by examiner

*Primary Examiner*—Timothy L. Maust
(74) *Attorney, Agent, or Firm*—J. Lanny Tucker

(57) ABSTRACT

A system and method are provided for the safe removal of a wet, fully-plated cathode from a silver recovery cell and its replacement by a fresh cathode. The fresh cathode is brought to the recovery cell in a transport housing, which is then docked thereto. A drip tray is unfolded from the transport housing so as to extend across and surround the top of the recovery cell. The fresh cathode is removed from the transport housing and put to one side. The used cathode is removed from the recovery cell, preferably by being attached to the lid which is unscrewed therefrom. The cathode is then transferred to the housing over the drip tray which catches any liquid falling therefrom. The used cathode is screwed into the transport housing, and the housing removed to a refiner for safe disposal, while the fresh electrode is screwed onto the recovery cell.

14 Claims, 5 Drawing Sheets

SYSTEM FOR, AND METHOD OF, REMOVING A COMPONENT FROM IMMERSION IN A LIQUID

FIELD OF THE INVENTION

This invention relates to a system for, and a method of, removing a component from immersion in a liquid. In particular, the invention relates to the removal of a used liquid treatment component from a container in a convenient manner, whereby any drips of liquid from the component are substantially prevented from contacting the user and any other part of the equipment from which the component is removed. The invention finds particular, though not exclusive, application in a photo-processing system, for example in the removal of a used cathode from an electrolytic silver recovery system, or the removal of a filter cartridge or an ion exchange column. The invention also extends to the replacement of the removed used component with a fresh component.

BACKGROUND OF THE INVENTION

Although the invention has broader application, for convenience the description will generally relate to its usage in a photo-processing system, and specifically to the removal, and replacement, of a cathode of an electrolytic silver recovery system thereof.

A silver recovery cell, or cartridge, contains a cathode on which silver is plated during operation, for example during the recovery of silver from a fixer solution in a tank of a photo-processor. When the cathode is fully loaded with silver, it has to be removed from the cell by the user. The cathode may be of the reusable type, in which case the silver is removed and the cleaned cathode is replaced in the cell; the silver being sent to a refiner. However, this operation of removing the silver from a cathode is both messy and inconvenient. This inconvenience is reduced when a disposable cathode is used, in which the cathode is generally made of a low-cost conductive material which can be smelted along with the silver. Typical materials for such a disposable cathode are graphite impregnated plastic, graphite foil laminated to plastic sheet, and plastic sheet painted with conductive ink. For a recovery cell having a disposable cathode, the user simply removes the cathode and replaces it with a fresh one; the used cathode then being sent in its entirety for refining.

U.S. Pat. No. 5,370,781 discloses a disposable cathode for use in an electrolytic cell, in which the action of screwing down a lid of the cell both seals the cell and makes electrical contact with the cathode. When the cathode is full of silver, the lid is unscrewed and the wet cathode is removed either by hand or by means of a tool which grasps holes in the top of a cylindrical wall of the cathode. The cathode is removed from the cell and placed in a bag and sealed for transport to the refiner. The operation of removal, and exchange, of the cathode is still messy and requires some skill on the part of the user to avoid contact between any liquid dripping from the cathode and the user and/or associated equipment.

U.S. Pat. No. 5,203,979 also discloses a disposable cathode, and whilst its large size reduces the frequency of changing, the cell must be drained in order to change the cathode, so that bolts passing through the cathode and the cell wall may be released. Removal of the cylindrical cathode is done either manually or by a tool. This operation is both time consuming and messy, especially bearing in mind that the wet cathode may weigh up to several kilograms.

U.S. Pat. No. 4,834,849 discloses yet another type of disposable cathode construction in which the cathode is in the form of conductive paint on a plastic substrate. Replacement of the cathode requires the cell to be drained of its photographic fixer solution, and although the extent of the manual operation is reduced, pouring of liquid, which may cause spills and drips onto associated equipment, is still involved. This method is, therefore, likewise not suited to operation of the cell in an office-like environment.

PROBLEM TO BE SOLVED BY THE INVENTION

It is an object of the present invention to provide a system and method that enables a wet component to be removed from immersion in a liquid easily and rapidly, without the need for draining and re-filling of the containment vessel, whilst minimizing not only contact between the user with the liquid, for example a photographic fixer solution, but also with the silver contained therein, and also whilst containing any drips from the wet component in a safe manner during and after removal.

SUMMARY OF THE INVENTION

In accordance with one aspect of the present invention, there is provided a system for removing a wet component from a canister for containing a liquid, comprising:

a canister which, in operation, removably contains the component at least partially immersed in the liquid;

a transport housing arranged to receive the component for transport away from the canister;

interengaging means for temporarily locating the transport housing in a position adjacent the canister, and preferably secured thereto; and a liquid collector arranged to be disposed between the canister and the transport housing so as to collect any liquid released from the component as the component is transferred from the canister to the transport housing.

It will be appreciated that at the time of removal of the component from the canister, the canister may still contain solution, or the solution may have recently been drained therefrom leaving the component still wet.

By 'canister' is meant a vessel of any shape, capable of containing liquid and into which the component is at least partially immersed at some time during operation.

By 'transport housing' is meant a receptacle, rigid or flexible, of any shape capable of receiving the component.

By 'interengaging means' is meant any means rigid or flexible, integral with or separate to, the transport housing capable of locating the transport housing adjacent the canister.

The interengaging means may locate the transport housing in a predetermined spatial relationship with the canister, for example alongside or above the canister. The liquid collector may be deployable so as to extend between the canister and the transport housing. In one embodiment, the transport housing is located a fixed distance laterally from the canister so that deployment of the liquid collector will result in its correct positioning between the canister and the transport housing. This is particularly convenient when the liquid collector is relatively rigid.

Advantageously, the liquid collector may be associated with, for example by being retained on or in, the transport housing. The liquid collector may then be unfolded from the transport housing when the latter is secured to the canister.

Unfolding of the liquid collector is to be understood as including not only opening it out from an overlapped configuration, but also unfurling, unwinding or otherwise flattening it out from a crumpled state.

Introduction of the wet component into the transport housing may be arranged to carry the liquid collector with it, so that its return to the housing is achieved without any risk of contact between the operator and the liquid.

In a preferred system, the component is fixed to a lid of the canister. Transfer of the component to the transport housing is then achieved by detaching, for example unscrewing, the lid from the canister and attaching, for example screwing, the lid onto the transport housing so as to provide a lid thereof It will be appreciated that the lid may form a seal onto each of the canister and transport housing, thereby safely to contain the liquid therein.

The interengaging means may comprise a support member extending laterally of the canister for securing the transport housing to the canister. The support member may be generally planar, and may be attached to the canister, or to an enclosure thereof Preferably the support member has an aperture therein for receiving the transport housing. The aperture may be such as to enclose the total periphery of the transport housing, or may comprise an open ended slot into which the housing may fit. Alternatively, the interengaging means may comprise a clamping member, which may be affixed to the transport housing, arranged to engage with a cooperating member fixed to the canister or to an enclosure thereof Advantageously, the liquid collector forms part of, and is carried by, the transport housing, so that any drips collected thereby may be safely removed and conveniently dealt with away from the vicinity of the canister.

In one embodiment the liquid collector is arranged to unfold from the transport housing so as at least partially, and preferably substantially entirely, to surround the canister when the transport housing and the canister are interengaged. To this end, the liquid collector may be apertured so as to pass over the top of and to enclose the canister. The aperture may be in the form of an open ended slot, to extend, for example, for an angle of arc of approximately 270° around the canister.

The liquid collector may comprise a material for retaining the liquid, and may be an absorbent or adsorbent material. Examples of absorbent material include cotton wadding, blotting paper, sponge and synthetic absorbent composites. In another configuration, the liquid collector may comprise a tray having a peripheral wall that forms a containment barrier around the canister and the transport housing for any liquid dripping from the transferred component. In this configuration, the drip tray in its folded configuration may form a seal for the liquid when folded back onto the transport housing containing the transferred wet component.

The liquid collector may be formed integrally with the transport housing.

The transport housing may be arranged to be located over the canister, and the action of mounting the housing on the canister may be arranged to deploy the liquid collector. The liquid collector may be operable, for example comprising flaps or a rim, by the action of mounting the transport housing on, or removing it from, the canister.

The transport housing may include a flexible bag, of a material that is impervious to the liquid. An operator may then remove the wet component from the canister and transfer it to the transport housing using the bag as a glove, or sleeve, for protection against the liquid.

The interengaging means may itself form part of the transport housing.

The transport housing may be arranged to be mounted on top of the canister, with the liquid collector located around an opening in the top thereof.

The liquid collector may comprise a bag for receiving the component from the canister, and co-operates with interengaging means for retaining the liquid.

Advantageously, the transport housing when it is brought up to the canister, includes a fresh component therewithin that is to take the place of the said, used, component that is removed from the canister. Thus, when the component is attached to a lid, the fresh component may be secured in the transport housing by means of a screw on lid, which is then transferred to the canister so as to form a sealed lid therewith, whilst the used component is secured in the transport housing by means of its screw-on lid, for safe removal from the equipment with which the canister is associated.

The canister and the transport housing, and preferably also the component, may be of generally cylindrical configuration.

In a preferred embodiment, the system of the present invention forms part of a photoprocessing system. For example the canister may comprise an electrolytic cell for the recovery of metal, for example silver, from a solution, which may be a photoprocessing solution, and the component may comprise a cathode of the cell. Alternatively, the canister may comprise a housing for a filter, or an ion exchange column, and the component may comprise a filter cartridge or element of the column.

In accordance with a further aspect of the present invention, there is provided a method of removing a wet component from a canister for containing liquid, wherein a transport housing for transporting the component away from the canister is temporarily located adjacent, for example on, the canister, and wherein a liquid collector is disposed between the canister and the transport housing so as to collect any liquid released from the component as the component is transferred from the canister to the transport housing.

It will be appreciated that the method may be used with the system described above for the removal, and preferably exchange, of a component immersed in liquid.

In accordance with a still further aspect of the present invention, there is provided a transport housing for a component carrying liquid, wherein the housing comprises:

a chamber for receiving the component therein;

means for temporarily locating the housing adjacent a canister in which the component is, in operation, disposed at least partially immersed in a liquid; and a collector carried with, for example attached to, the housing for collecting any liquid released from the component during transfer to the housing. The liquid collector may be arranged to be deployed from the transport housing when the transport housing is located adjacent the canister so as to extend therebetween so as thereby to collect the liquid.

By 'chamber' is meant an enclosed space capable of receiving the component therein.

Advantageously, the transport housing will be arranged to be located side-by-side with the canister so that the deployed liquid collector forms a substantially planar surface therebetween. Alternatively, the housing may be located on top of the canister.

The invention is particularly applicable where the component is to be removed through the top of the canister, thus avoiding the need for any draining or refilling thereof.

The canister may be in the form of the silver recovery electrolytic cell described in our contemporaneously-filed patent application number GB 985169.9 docket 77893.

Although the liquid collector may be provided as a relatively rigid component, at least to the extent that it is self supporting, it is also envisaged that it could be formed as a more flexible element. In this latter aspect, it is envisaged that the liquid collector may be stored inside the transport housing, alongside or beneath a fresh component if included therein. Upon mounting adjacent the canister, the collector may be unfolded, and flattened out if necessary, and positioned between the transport housing and the canister. To assist in this, the liquid collector may be slit from its outer periphery inwards to an aperture that forms a push fit over the canister. Advantageously, the liquid collector may have an aperture to be positioned over the transport housing, the size of the aperture being less than that of the component. In this configuration, insertion of the component into the transport housing after its removal from the canister will serve to fold back the liquid collector into the transport housing.

ADVANTAGEOUS EFFECT OF THE INVENTION

The securement of the transport housing to the canister, and the provision of means therebetween for collecting any liquid that drips from the component as it is transferred from the canister to the transport housing, ensures that none of the liquid will fall onto an operator or onto equipment with which the canister is associated. This is particularly advantageous when the liquid involved is toxic, flammable, or corrosive, or otherwise hazardous, being, for example, a solvent or an acid.

Particularly when the component is attached to a lid of the canister, any risk of contact by the user with the liquid, or with any other material adhering to the component, is minimized.

Arranging for the liquid collector to be folded away, and particularly to be folded onto or into the transport housing, results in a very simple system. Although when the liquid collector is provided as a relatively rigid element, a certain degree of registration needs to be achieved between the transport housing and the canister, this can be obviated by making the collector of a more flexible material.

Since the liquid collector will be able to retain only a certain amount of liquid, it being primarily arranged to trap drips from the transferred component, care and time should be taken when removing the component from the canister so that as much liquid as possible is allowed to drain back into the canister, before the component is transferred to the transport housing.

Where the component is an electrical component, as for example being a cathode of an electrolytic cell, then electrical connection to the component can advantageously be made via a lid of the canister, such that the component, preferably together with the lid, can be removed without the need to drain the cell of its liquid. In this respect, the system disclosed in our contemporaneously-filed patent application number GB 9815172.3 docket No. 77944 finds particular application.

BRIEF DESCRIPTION OF THE DRAWINGS

Systems for, and methods of, removing a component from immersion in liquid, will now be described, by way of example, with reference to the accompanying drawings, in which.

DETAILED DESCRIPTION OF THE INVENTION

Figure 1:
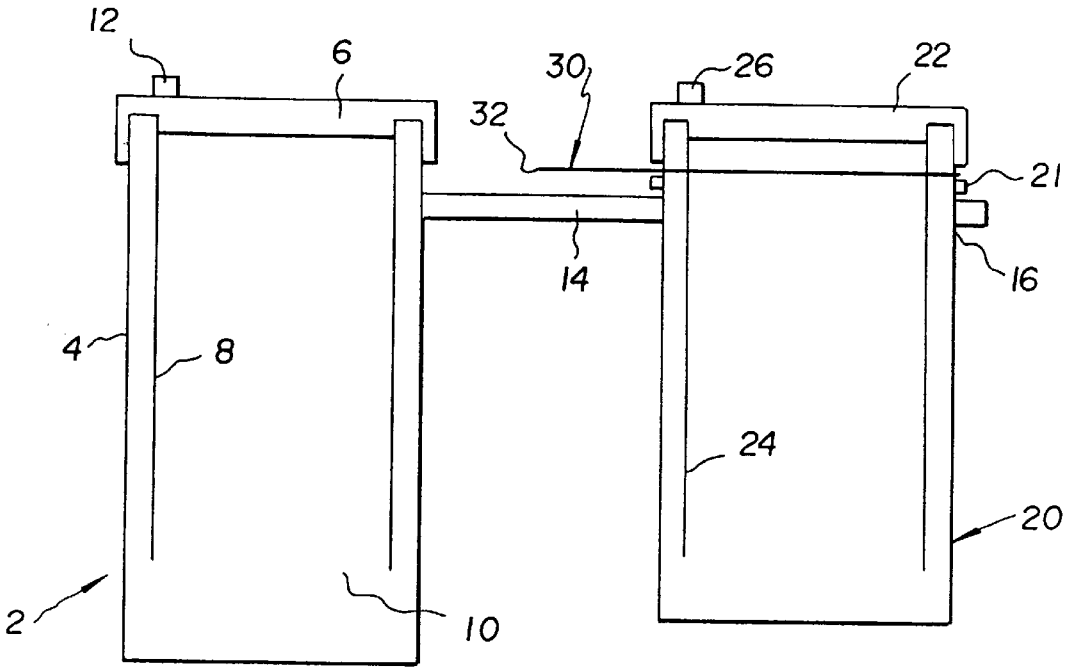
FIG. 1 is a schematic elevation of one embodiment of a transport housing of the system secured to the canister, which is provided as a silver recovery cell of a photoprocessor.
Figure 2:
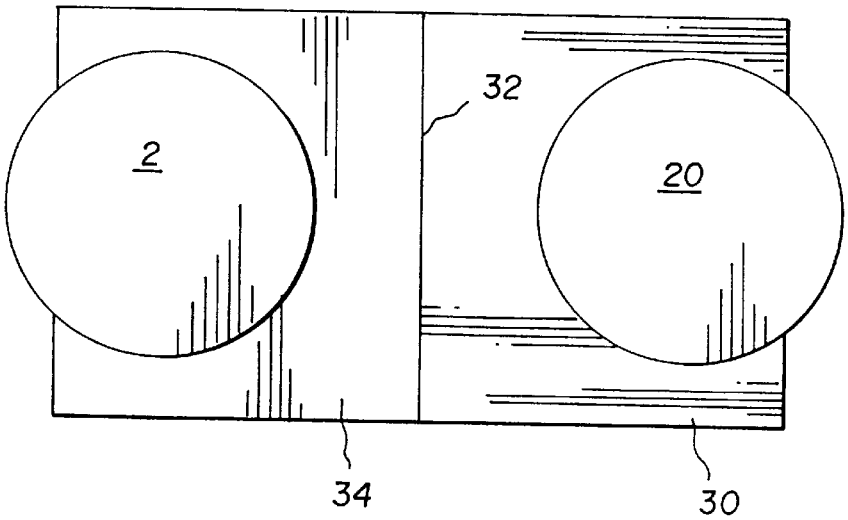
FIG. 2 is a plan view of the system of FIG. 1, showing the liquid collector of the system in its deployed configuration.

Referring to FIGS. 1 and 2, a silver recovery cell 2 is shown schematically as comprising a cylindrical container 4 that is closed and sealed by a screw-on lid 6. A cylindrical cathode 8 is attached to the lid 6 and depends downwardly therefrom into a photographic fixer solution 10 that fills the container 4. Electrical connection from the cathode 8 extends through the lid 6 to a terminal 12 and thence via a connector (not shown) to appropriate electrical equipment (not shown). A rigid plate 14 is fixed to an upper part of the cylindrical wall of the container 4 so as to extend to one side thereof substantially horizontally. The plate 14 has a circular aperture 16 therein laterally spaced apart from the cell 2.

The plate 14 together with its aperture 16 forms a docking station for a cylindrical transport housing 20 that is closed by a lid 22 from which a cathode 24 depends downwardly.

The transport housing 20 is retained in the aperture 16 by engagement therewith of an external annular ridge 21. Electrical connection from the cathode 24 extends up through the lid 22 to an external terminal 26. The lid 22, cathode 24 and terminal 26 of the transport housing 20 are in all material respects identical with the lid 6, cathode 8 and terminal 12 of the cell 2 respectively.

The transport housing 20 carries a splash guard or apron or drip tray 30, affixed thereto above the retaining ridge 21. The drip tray 30 is of generally rectangular configuration, and as shown in FIG. 1 is stored such that it is folded over onto itself for convenience during transport of the housing 20. Thus, the upper portion of the tray 30 is apertured so as to be foldable over the cylindrical housing 20, and is retained in place by being tucked under the screwed on lid 22.

The docking plate 14 is made as small as conveniently possible, and this typically results in the transport housing 20 being mounted in the aperture 16 at a distance of a few centimeters laterally away from the silver recovery cell 2.

In operation of the silver recovery cell 2 with a photoprocessor (not shown), silver from the fixer solution 10 becomes plated onto the cathode 8. In time, the cathode becomes effectively fully plated and needs to be replaced. At this stage, the transport housing 20 carrying a fresh cathode 24 is mounted on the docking plate 14 (FIG. 1). The electrical connection to the used cathode 8 at terminal 12 is disengaged. The lid 22 with its attached cathode 24 is unscrewed and temporarily placed aside in a safe location. The drip tray 30 can then be unfolded about its fold line 32 such that its upper surface 34 (FIG. 2) sits around the recovery cell 2 owing to the registration of the docking plate aperture 16 with the cell 2. In this way, as can be seen from FIG. 2, the drip tray 30 extends totally between the cell 2 containing the used cathode 8 and the, now empty, transport housing 20. Advantageously, as shown, the tray 30 also extends a short distance laterally of the cell 2 and housing 20 to provide further protection of the equipment (not shown) with which the cell 2 is associated. The lid 6 of the cell 2 is now unscrewed and removed, thereby drawing the cathode 8 out of the solution 10. As much of the solution 10 as possible is allowed to drain back into the cell 2, and the lid 6 and cathode 8 are then transferred over the surface of the drip tray 30 to the transport housing 20. The lid 6 is then securely screwed onto the housing 20 to seal thereunto, and the drip tray 30 is folded back onto itself Advantageously the tray 30 is folded just before the lid 6 is secured on to the housing 20 so that the folded tray 30 can again be retained safely by the lid. The fresh cathode 24 may then be introduced into the recovery cell 2 with the lid 22 being screwed sealingly onto the container 4. Electrical connection is re-established to the new cathode 24 via its terminal 26, and operation of the cell 2 can be resumed. The transport housing 20 carrying the used electrode 8 can then be carried away to a refiner for safe disposal.

It is thus seen that the cathodes may be exchanged and the used cathode removed from the vicinity of the recovery cell 2, and thus of the photoprocessor, without any need for the user to contact the cathode 8 or the solution 10, and whilst avoiding any drips of solution 10 from the cathode 8 reaching any of the equipment associated with the cell 2. Removal of the used cathode 8 from the transport housing 2 and its disposal may then be safely carried out in more suitable and controlled conditions.

Figure 3:
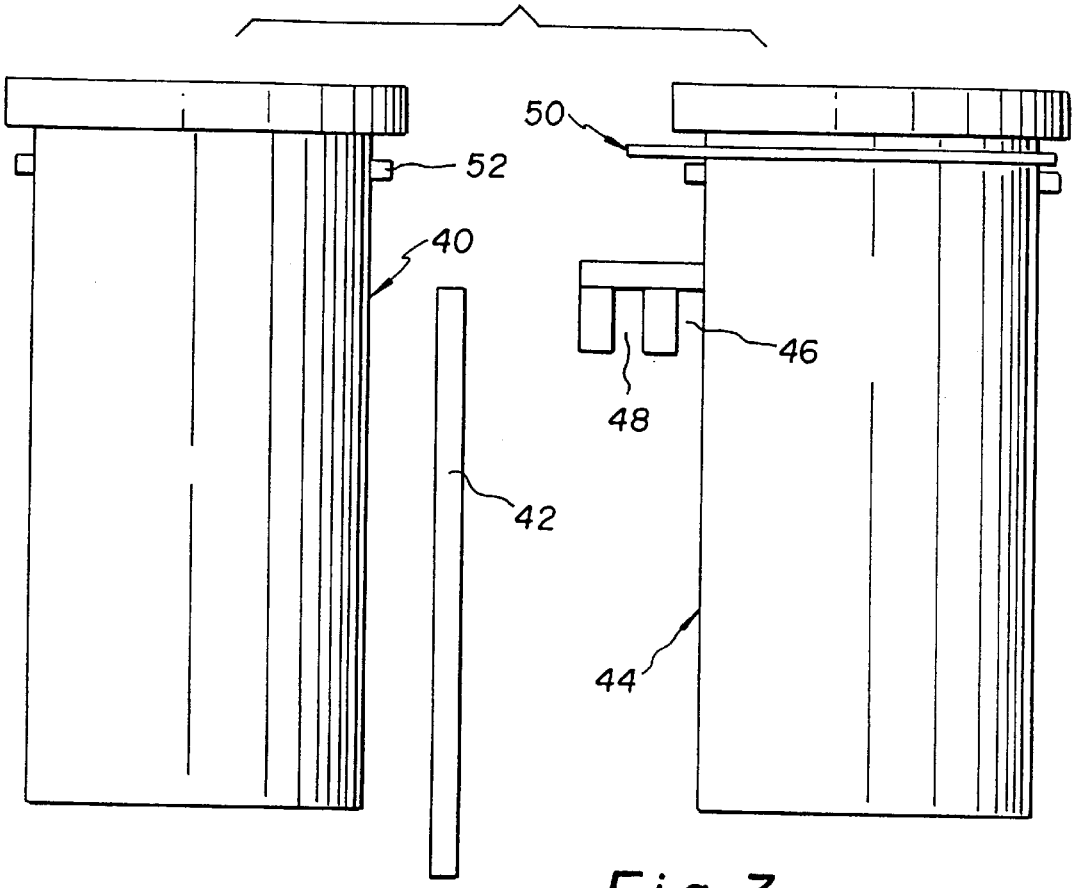
FIG. 3 is a view corresponding to that of FIG. 1 of an alternative embodiment.

An alternative system of docking the transport housing to the recovery cell is shown in FIG. 3, in which a cell 40 is shown schematically located behind a side wall 42 of the housing of a photoprocessor. A transport housing 44, which may be substantially of the same form as the transport housing 20 of FIG. 1, is, in this embodiment, provided with a docking clamp 46 that extends to one side thereof. The clamp 46 is of generally U-shape, the channel 48 of which is of a width so as to fit securely over the top of the processor side wall 42. The lateral spacing apart of the cell 40, side wall 42, and clamp 46 with its channel 48, are arranged so that the housing 44 can be mounted in registration with the cell 40 so that its drip tray 50 may be deployed, as described with respect to FIGS. 1 and 2, so as snugly to fit around the cell 40.

As also shown in the embodiment of FIG. 3, the cell 40 is provided with an external annular ridge 52 which can be used to support the unfolded drip tray 50.

The embodiment of FIG. 3 is preferred where there is insufficient space around the silver recovery cell or its associated photoprocessing equipment for a permanent docking system, such as the plate 14 of FIG. 1 embodiment, to be provided therewith. As shown in the embodiment of FIG. 3, the transport housing 44 is attached to the wall 42 of the photoprocessor, but it is also envisaged that it could be mounted directly onto the cell 40.

Figure 4:
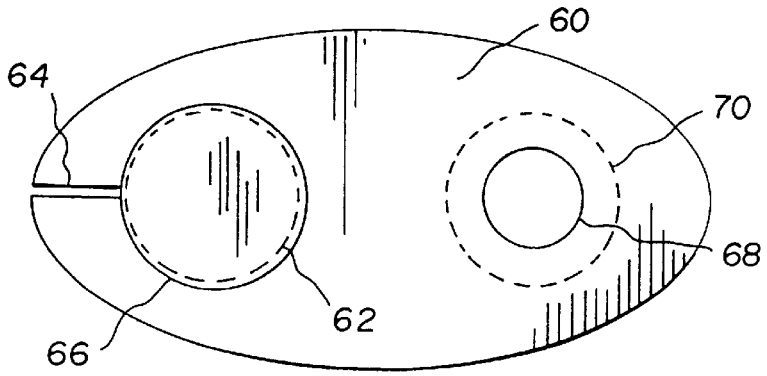
FIG. 4 is a view corresponding to that of FIG. 2 showing an alternative embodiment.

Referring to FIG. 4, the schematic plan view shows a flexible drip tray 60 in its deployed configuration extending from a transport housing (not shown, beneath the plane of the figure) to a silver recovery cell, whose cylindrical container is shown as in broken outline 62. The drip tray 60 is of generally oval shape and has a slit 64 at one end of its major axis that extends into a circular aperture 66, so that the tray 60 may be pressed into a sealing position around the recovery cell 62. The flexible drip tray 60 is provided with a smaller hole 68 towards the other end of its major axis, the diameter of the hole 68 being less than the diameter of a cylindrical cathode as shown by the broken outline 70, with which it is to be used.

In this embodiment, the flexible drip tray 60 is associated with the cathode rather than with transport housing itself. The drip tray 60 is stored within the transport housing and is deployed by hand when the new cathode is removed therefrom. During transport, the flexible drip tray 60 may be folded or otherwise crumpled up within or around the cathode itself Upon removal from the transport housing, the drip tray 60 may be flattened out to the configuration as seen in FIG. 4. Removal of the drip tray 60 may be facilitated by having it removably secured, for example by a low tack glue, to the lower circumference of the fresh cathode.

By making the drip tray flexible, it is possible to make it larger than is otherwise convenient, and in particular it may easily be made of a size such that it can substantially surround the entire circumference of both the transport housing and the recovery cell, thereby enhancing its ability to ensure that all drips from the cathode are caught during transfer.

When the used cathode is inserted into the transport housing of the embodiment of FIG. 4, then since it is larger than the aperture 68, this action causes the drip tray 60 to become folded and forced down into the transport housing carrying any drips with it. It will be appreciated that this action does not require any contact by the user with the drip tray, other than possibly assisting in its detachment from the recovery cell 62.

In a still further embodiment, a flexible drip tray may be attached to a sliding ring which is retained inside the transport housing, the ring allowing the tray to be withdrawn when the fresh cathode is removed. Replacement is achieved as described with respect to FIG. 4 above.

The drip tray, in its rigid or more flexible form, may be formed from a thin sheet of material, for example plastic, whose upper surface, when deployed, is covered with an absorbent material. However, it is also envisaged that the drip tray may be provided as a single layer of absorbent material.

It will be appreciated that when the drip tray is provided in a relatively flexible form, the registration of the transport housing with respect to the recovery cell need not be so precise.

It is also envisaged that the drip tray need not contain absorbent material for containment of any spillage or drips from the used cathode, but may alternatively be shaped so as to have a raised lip at its outer circumference. The raised edge may be interlocked when the tray is folded so as to form a seal, and when the tray is deployed will form a containment barrier around the upper surface of the recovery cell and transport housing. For example the tray may be provided with a clip of other kind of fastener including a touch to close system such as a Velcro (trademark) fastener.

Figure 5:
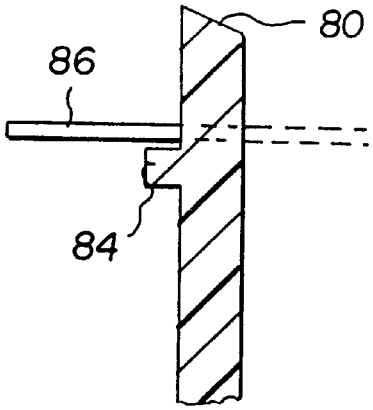
FIG. 5 shows a detail of the top of the transport housing of FIGS. 1 and 3.
Figure 6:
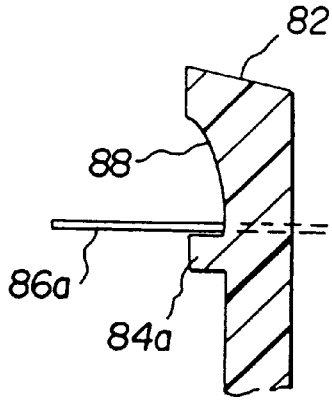
FIG. 6 shows a detail of the top of the canister of FIGS. 1 and 3.

The upper part of the transport housing and of the silver recovery cell may be shaped in such a way as to assist in taking care of the flow of drips and spillage. As shown in FIGS. 5 and 6 respectively, the upper surfaces are shaped at 80 and 82 respectively so as to direct liquid back into the interior of the container. Additionally, a ridge 84, 84*a* extends around the outside of the container for receiving a drip tray 86, 86*a* in close proximity thereto to prevent liquid falling between the tray and the outer surface of the container. In the embodiment of FIG. 6, this function is assisted by the radiused surface 88, which allows the tray 86*a,* to unfold into place on the ridge 84*a* below the rim of the canister.

Figure 7:
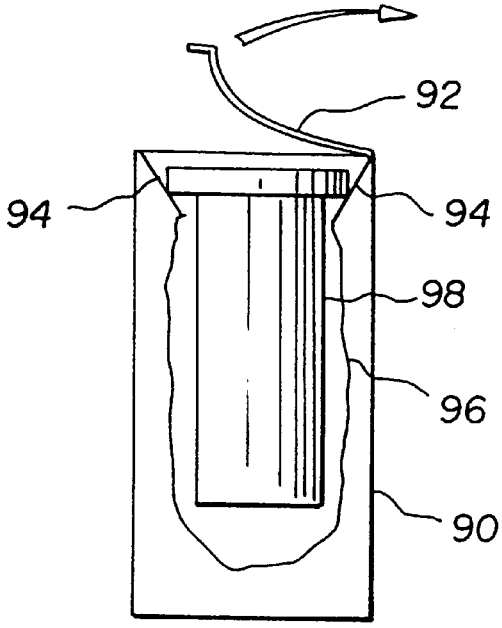
FIG. 7 is a schematic elevation of a further embodiment of a transport housing of the system.
Figure 8:
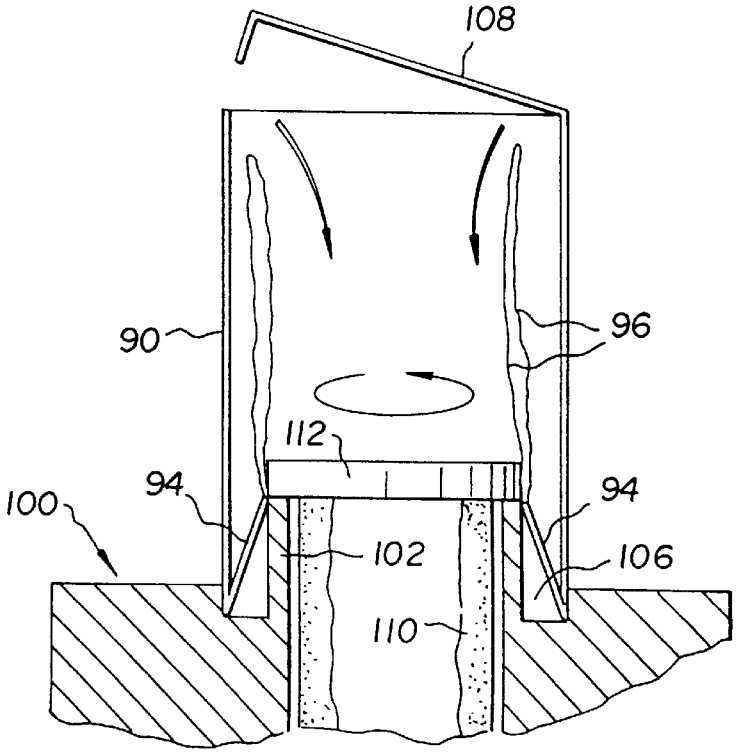
FIG. 8 shows the transport housing of FIG. 7 inverted and located on an electrolytic cell.

Referring to FIGS. 7 and 8, a transport housing 90 is in the form of an elongate cardboard box of rectangular cross section. The box 90 is closed at one end, the upper end as seen in FIG. 7, by a peel-off cover 92. A flap 94 extends into the box 90 from each side thereof at this end, and a plastic bag 96 is attached to the interleaving flaps 94. The box 90 contains a fresh replacement cylindrical cathode 98 for an electrolytic cell 100, the cathode 98 extending into the bag 96 and being supported by the flaps 94.

The box 90 is brought to the cell 100. The cover 92 is peeled off and the replacement cathode 98 withdrawn and put to one side temporarily. Removing the cathode 98 from the box 90 results in the flaps 94 closing slightly, to leave a gap that is smaller than the opening neck 102 of the cell 100. As can be seen from FIG. 8, the neck 102 extends upwardly from a recess 106 of the cell 100. The box 90 is then inverted and placed over the cell 100, with the open edge of the box fitting into the recess 106. This action spreads the flaps 94 and draws the bag 96 down around the cell neck 102. A hinged cover 108 at the free end of the box 90 is opened, and the operator inserts a hand into the box 90 and, using the impermeable bag 96 as a barrier to liquid contamination, unscrews the fully silver-loaded cathode 110 attached to the cell lid 112, and withdraws it upwards in the bag 96 into the box 90. Once the cathode 110 has been lifted out of the cell and is above the cell neck 102, the box is then slowly lifted off the cell 100, and the interleaving flaps 94 close slightly beneath the cathode 110, such that their opening is smaller than the diameter of the cathode. The cathode may then be lowered onto the flaps, and its weight closes the flaps further. The wet cathode 110 and any liquid dripping therefrom is thus contained within the volume defined by the bag 96 and flaps 94. The box 90 is then returned to its upright position with the hinged cover 108 being securely closed. The peel off cover 92 may then be replaced over the open end of the box 90, or the box 90 may be sealed in another manner, for example by being placed into a further liquid-tight bag for transfer to a refiner. The fresh, dry replacement cathode 98 may then be screwed into position on the cell 100.

Figure 9:
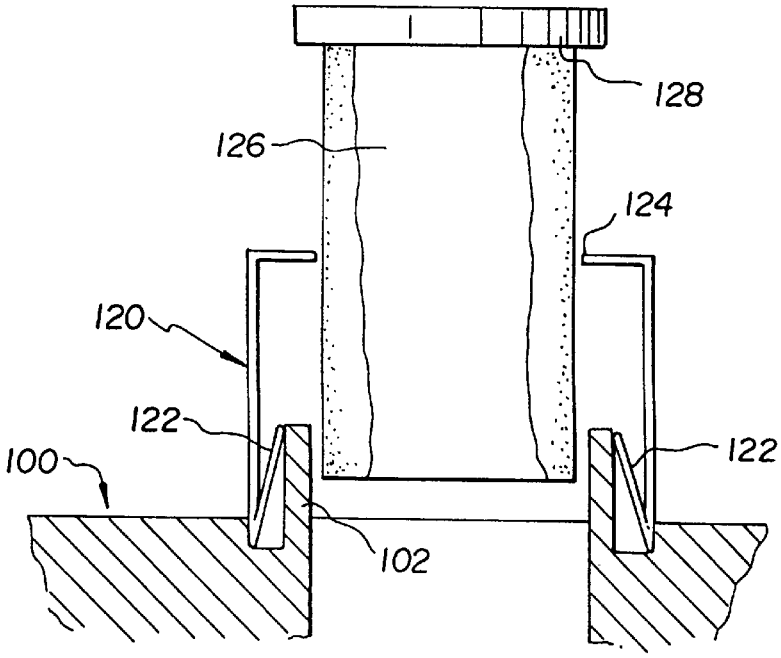
FIG. 9 shows a schematic elevation of a further embodiment of transport housing mounted on an electrolytic cell.

FIG. 9 shows a further embodiment of transport housing, which is a modification of the concept used in the embodiment described with reference to FIGS. 7 and 8. In this embodiment, the transport housing is formed as a shortened box or sleeve 120 of circular cross section with an inwardly-turned continuous rim 122 at one end thereof, being shown opened as the sleeve 120 is fitted around the neck 102 of the cell 100. The sleeve 120 contains no inner bag, but the inner surface thereof and the rim 122 are of, or coated with, a material that is impervious to the liquid within the cell 100. The operator introduces a hand through the open end 124 of the sleeve 120 to unscrew and withdraw the silver-loaded cathode 126 up through, but not completely out of, the sleeve 120. It will be appreciated that the cathode 126 is integral with the lid 128 of the cell 100, and can thus be safely removed. With the cathode 126 in the position shown in FIG. 9, the sleeve 120 is pulled up off the cell neck 102, thus again allowing the rim 122 partially to relax beneath, and to contain, the wet cathode 126, the diameter of the opening in the rim 122 being less than the diameter of the cathode. In this way, any spillage or drips from the cathode 126 can be retained within the sleeve 120 by the rim 122. The assembly of sleeve 120 and cathode 126 can then be transferred to a liquid-tight bag or box for removal to the refiner.

Figure 10:
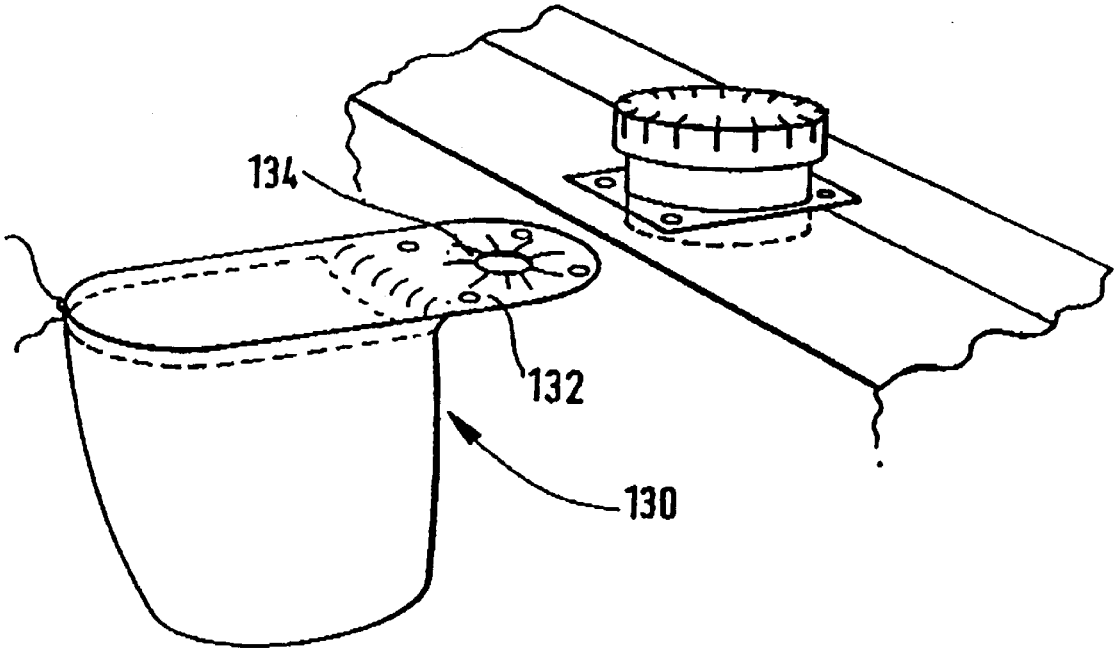
FIG. 10 is a schematic view of a flexible transport housing of the system of the invention.

FIG. 10 shows a further embodiment of a transport housing. In this embodiment the housing is in the form of a flexible bag 130. The bag may be closed by a drawstring system. Alternatively a ziplock can be used to ensure a liquid tight seal. The bag 130 has a self contained flap 132 which acts as a drip tray. The flap 132 is provided within an elasticated opening 134. The drip tray may be provided as a separate component. The bag 130 is supplied in a bag in box system containing a fresh cathode. The fresh cathode 138 is withdrawn and put to one side temporarily. As can be see in FIG. 10, the bag 130 from the canister 136 is brought over to the recovery unit and located by means of pegs or bosses over the lid of the cell. The elasticated opening 134 forms a liquid tight seal around the neck of the cell. The fully silver loaded cathode is unscrewed and transferred to the flexible bag 130. By virtue of the flap 132 all drips from the cathode will be collected in the bag, avoiding spillage onto surrounding equipment. Once the cathode is in the flexible bag 130 the bag is removed from the recovery unit and the flap 132 folded within, alongside the cathode. The fresh cathode may then be screwed into position on the unit.

Although the present invention has been specifically described with respect to the removal and exchange of cathodes of an electrolytic silver recovery cell, it will be appreciated that the systems and methods may be used in other applications where it is desired to transport items such as a liquid treatment cartridge, filter or module, or other wet replaceable part, including machine or engine parts which may be soaked in oil or other non-aqueous fluids, where it is desired to prevent contact by the user with solutions and to catch any falling drips. In the photoprocessing field itself, for example, the invention also finds application in changing filter cartridges or ion exchange columns. The invention may also find use in medical applications where it is desired to prevent contact by the user with solutions.

The invention has been described in detail with particular reference to certain preferred embodiments thereof, but it will be understood that variations and modifications can be effected within the spirit and scope of the invention.

| Parts List | |
|---|---|
| 2 | cell |
| 4 | cylindrical container |
| 6 | lid |
| 8 | cathode |
| 10 | fixer solution |
| 12 | terminal |
| 14 | plate |
| 16 | aperture |
| 20 | housing |
| 21 | ridge |
| 22 | lid |
| 24 | cathode |
| 26 | terminal |
| 30 | drip tray |
| 32 | fold line |
| 34 | upper surface of tray |
| 40 | cell |

-continued

| Parts List | |
|---|---|
| 42 | side wall |
| 44 | housing |
| 46 | docking clamp |
| 48 | channel |
| 50 | drip tray |
| 52 | ridge |
| 60 | drip tray |
| 62 | cell |
| 64 | slit |
| 66 | aperture |
| 68 | hole |
| 70 | cathode |
| 80 | upper part of housing |
| 82 | upper part of cell |
| 84, 84a | ridge |
| 86, 86a | drip tray |
| 88 | surface of cell |
| 90 | housing |
| 92 | cover |
| 94 | flap |
| 96 | plastic bag |
| 98 | cathode |
| 100 | cell |
| 102 | neck of cell |
| 106 | recess in cell |
| 108 | hinged cover |
| 110 | cathode |
| 112 | cell lid |
| 120 | housing |
| 122 | rim |
| 124 | open end of housing |
| 126 | cathode |
| 128 | lid |
| 130 | flexible bag |
| 132 | flap |
| 134 | elasticated opening |

We claim:

1. A system, forming part of a photoprocessing system, for removing a wet component from a canister for containing a liquid, comprising; a canister which, in operation, removably contains the component at least partially immersed in the liquid; a transport housing arranged to receive the component for transport away from the canister; interengaging means for temporarily locating the transport housing in a position adjacent the canister; and a liquid collector arranged to be disposed between the canister and the transport housing so as to collect any liquid released from the component as the component is transferred from the canister to the transport housing.

2. A system according to claim 1, wherein the interengaging means locates the transport housing in a predetermined spatial relationship with the canister, and wherein the liquid collector is deployable so as to extend between the canister and transport housing prior to transfer of the component therebetween.

3. A system according to claim 1, wherein the interengaging means comprises a support member extending laterally of the canister, and attached thereto, for locating the transport housing on the canister, in an aperture of the support member.

4. A system according to claim 1, wherein the liquid collector is carried by the transport housing.

5. A system according to claim 4, wherein the liquid collector is deployed to at least partially surround the canister when the transport housing and the canister are interengaged by the interengaging means.

6. A system according to claim 1, wherein the liquid collector comprises a material for retaining the liquid.

7. A system according to claim 1, wherein the liquid collector comprises a bag for receiving the component from the canister, and co-operates with the interengaging means for retaining the liquid.

8. A system according to claim 1, wherein the canister comprises an ion exchange column, or a filter or solution treatment cartridge.

9. A system according to claim 1, wherein the canister comprises an elecrolytic cell for the recovery of metal from solution, and the component comprises a cathode of the cell.

10. A method of removing a wet component from a canister for containing liquid, wherein a transport housing for transporting the component away from the canister is temporarily located adjacent the canister, and wherein a liquid collector is disposed between the canister and the transport housing so as to collect any liquid released from the component as the component is transferred from the canister to the transport housing, the liquid collector being carried by the transport housing and being unfolded therefrom so as at least partially to surround the canister when the transport housing is secured to the canister.

11. A method according to claim 10, wherein the transport housing is secured in a predetermined spatial relationship with the canister, and wherein the liquid collector is deployed from the transport housing, so as to extend between the canister and the transport housing.

12. A method according to claim 10, wherein the transport housing is secured to the canister by being mounted by means of a support member extending laterally of the canister.

13. A method according to claim 10, wherein the liquid collector absorbs, and/or physically retains the liquid therein or thereon.

14. A method according to claim 10, for transferring a component from a canister to a transport housing of a system in accordance with claim 1.

* * * * *

UNITED STATES PATENT AND TRADEMARK OFFICE

CERTIFICATE OF CORRECTION

PATENT NO. : 6,179,019 B1
DATED : January 30, 2001
INVENTOR(S) : Bruce S. Gowans et al.

It is certified that error appears in the above-identified patent and that said Letters Patent is hereby corrected as shown below:

Title page,
Item [73], insert -- Assignee: Eastman Kodak Company, Rochester, New York --

Signed and Sealed this

Twenty-eighth Day of May, 2002

*Attest:*

*Attesting Officer*

JAMES E. ROGAN
*Director of the United States Patent and Trademark Office*